US006200437B1

(12) United States Patent
Clasen et al.

(10) Patent No.: US 6,200,437 B1
(45) Date of Patent: Mar. 13, 2001

(54) WALL-COVERING FOR ELECTROLYTIC CELLS

(75) Inventors: Peter Clasen, Krefeld; Stefan Venghaus, Kalkar; Horst Dykrzak, Moers, all of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/331,224

(22) PCT Filed: Jan. 3, 1998

(86) PCT No.: PCT/EP98/00017

§ 371 Date: Jun. 17, 1999

§ 102(e) Date: Jun. 17, 1999

(87) PCT Pub. No.: WO98/30736

PCT Pub. Date: Jul. 16, 1998

(30) Foreign Application Priority Data

Jan. 10, 1997 (DE) ..... 197 00 533

(51) Int. Cl.[7] ..... C25B 9/00
(52) U.S. Cl. ..... 204/279; 204/232; 204/242
(58) Field of Search ..... 204/279, 232, 204/242

(56) References Cited

U.S. PATENT DOCUMENTS

| | | | |
|---|---|---|---|
| 3,450,621 | 6/1969 | Anderson | 204/219 |
| 3,962,066 | 6/1976 | Barber et al. | 204/242 |
| 4,049,531 | 9/1977 | Ban | 204/275 |
| 4,060,475 | 11/1977 | Fournier et al. | 204/270 |
| 4,139,448 | 2/1979 | Wallace | 204/256 |
| 4,218,293 | 8/1980 | Nawrot | 204/267 |
| 4,283,263 | 8/1981 | Mirabelli | 204/219 |
| 4,402,809 | 9/1983 | Dilmore et al. | 204/254 |
| 4,422,919 | 12/1983 | Fabian et al. | 204/270 |
| 4,915,803 * | 4/1990 | Morris | 204/279 |
| 5,141,617 | 8/1992 | Nagy et al. | 204/231 |

FOREIGN PATENT DOCUMENTS

| | | |
|---|---|---|
| 26 09 212 | 6/1980 | (DE) . |
| 90 03 162 | 7/1990 | (DE) . |
| 075662 | 4/1983 | (EP) . |
| 478718 | 4/1992 | (EP) . |
| 1056712 | 1/1967 | (GB) . |
| 1385887 | 3/1975 | (GB) . |
| WO 93/08318 | 4/1993 | (WO) . |

* cited by examiner

*Primary Examiner*—Bruce F. Bell
(74) *Attorney, Agent, or Firm*—Norris McLaughlin & Marcus

(57) ABSTRACT

Anti-corrosive detachable wall-covering for side walls for new and used electrolytic cells holding chlorine-containing process gases.

5 Claims, 2 Drawing Sheets

WALL-COVERING FOR ELECTROLYTIC CELLS

The present invention relates to an anti-corrosion wall covering for side walls in apparatus designed to collect chlorine-containing process gases, in particular in electrolytic cells. The covering is detachable and is suitable in particular for use in new and used side pieces of electrolytic cells operating according to the amalgam process.

BACKGROUND OF THE INVENTION

Various methods are known for covering side walls of electrolytic cells used in the amalgam process, which are generally made of metal. A non-detachable covering of rubber (synthetic or natural rubber) is generally applied.

The non-detachable rubber covering is in other cases provided with an additionally bonded sheet of for example ethylene-propylene-terpolymer (see for example U.S. Pat. No. 3 450 621).

On rubber-covered side pieces dioxin-containing and furan-containing reaction products are in certain circumstances formed by reaction with chlorine gas. These are undesirable by-products on account of their toxicity, which have to be removed at great expense. When a side piece of an electrolytic apparatus is to be re-covered, the existing rubber covering must first of all be removed. This is normally achieved by cooling the rubber covering to a very low temperature, whereupon the covering becomes brittle and can then be mechanically removed, for example by chiselling off the adhering rubber residues.

A side piece covering comprising a combination of rubber and an additional polymer layer as described above is complicated to produce and is also expensive. If the rubber covering is damaged moist chlorine can come into contact with the surface of the side pieces, which are normally made of steel, and cause serious corrosion of the steel part. A proper repair welding of the bonded polymer covering is not possible in practice.

SUMMARY OF THE INVENTION

The object of the present invention is to provide coverings for used or new side pieces, for example for electrolytic cells, that do not have the disadvantages of the afore described prior art and that in particular are readily detachable for repair purposes.

This object is achieved according to the invention if the covering is made of welded or trimmed sheets of special plastics that are fastened together with a stability-imparting steel part to the floor of the apparatus.

The invention provides an anti-corrosion side wall for apparatus designed to collect chlorine-containing process gases, in particular for electrolytic cells, which is characterised in that a covering of optionally welded or trimmed sheets of polyvinylidene fluoride (PVDV), polytetrafluoroethylene-co-hexafluoropropylene (FEP), polyvinyl chloride (PVC or PVC-HT) or perfluoroalkoxy polymer (PFA) is placed, and optionally fixed with a detachable adhesive for mounting purposes, on a metal support structure of in particular steel or stainless steel that can be joined to the floor of the apparatus or further side parts by detachable securement means.

The individual plastics sheets for producing the covering may be trimmed and under optimum conditions joined to one another, for example by welding, before being mounted on the support structure. The overall surface of the metal support structure may in addition be provided with an anti-corrosion layer, for example a coating of DD paints or with epoxy resins.

Should the covering be damaged after its removal from the side piece, it can easily be repaired. The structurally determined gap between the covering and support structure furthermore enables the leak-proofness of the covering to be checked.

A thermal insulation, for example based on closed-cell polymer foams, especially polyurethane foam, is in particular additionally provided between the support structure and covering.

Although the plastics materials used according to the invention have a high coefficient of thermal expansion, tests have shown that the aforementioned plastics are particularly suitable for coverings of side pieces in electrolytic cells.

The proposed detachable side parts are used in particular in electrolytic cells for producing chlorine according to the amalgam process.

Sensors may be installed in the space between the covering and the side wall support structure, which permit testing for leaks of, for example, escaping chlorine or salt solution.

BRIEF DESCRIPTION OF THE DRAWINGS

The invention is described in more detail hereinafter with the aid of the accompanying drawings, though the invention is not restricted as regards the details thereof.

DETAILED DESCRIPTION OF THE INVENTION

EXAMPLE

Figure 1:
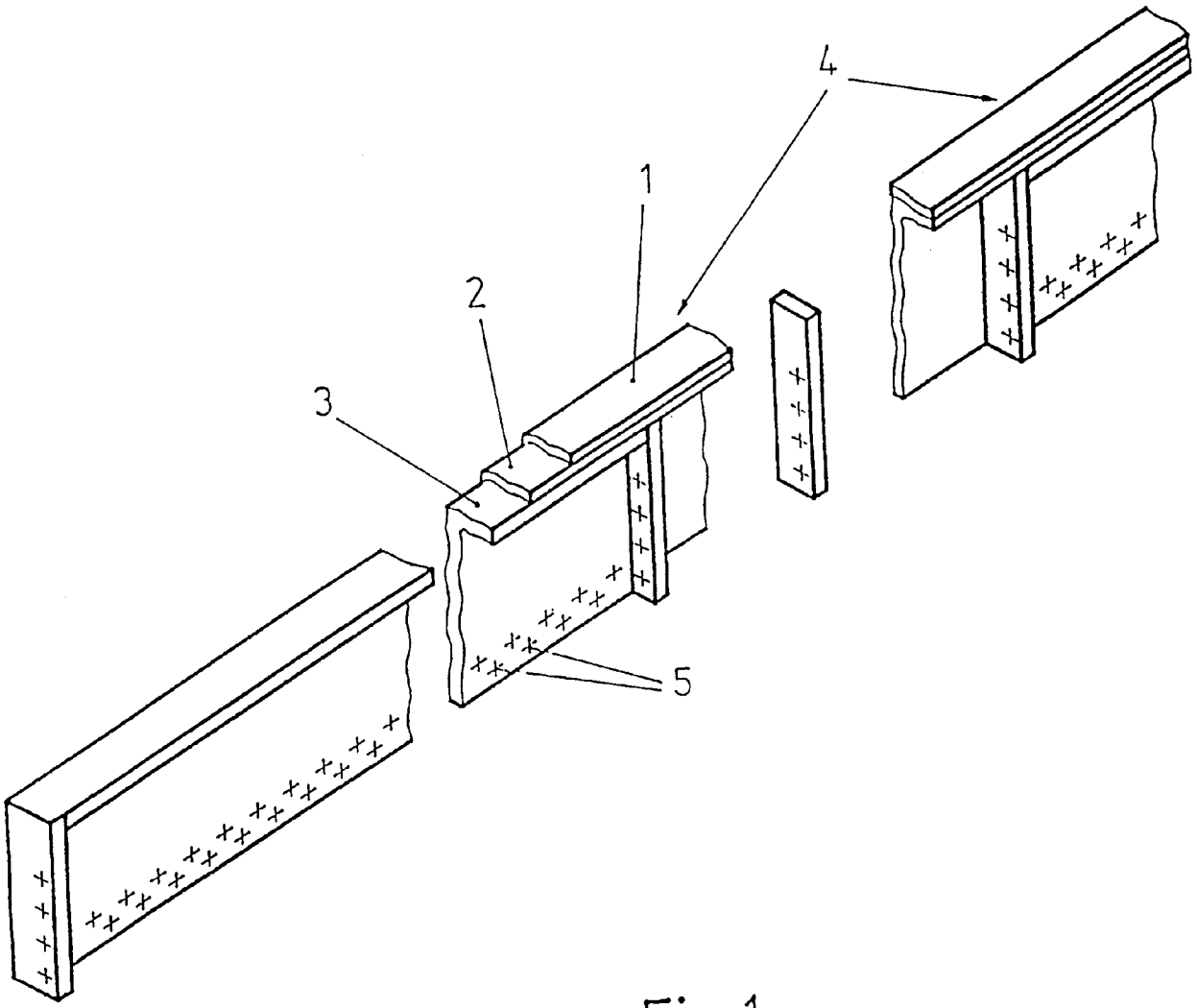
FIG. 1 is a side view of an embodiment of the apparatus covering according to the invention.

FIG. 1 shows a side wall 4 of an electrolytic cell in which chlorine is produced according to the amalgam process. A loose covering 1 of PVDF sheets lies on a steel support structure 3. The covering 1 had been fabricated by welding individual PVDF segments before being mounted on the side wall. An insulation layer 2 of polyurethane foam is in addition provided between the support structure 3 and covering 1. The bores 5 serve to mount the side wall 4 on the floor 6 of the electrolytic cell by means of screws 10 (see also FIG. 2).

Figure 2:
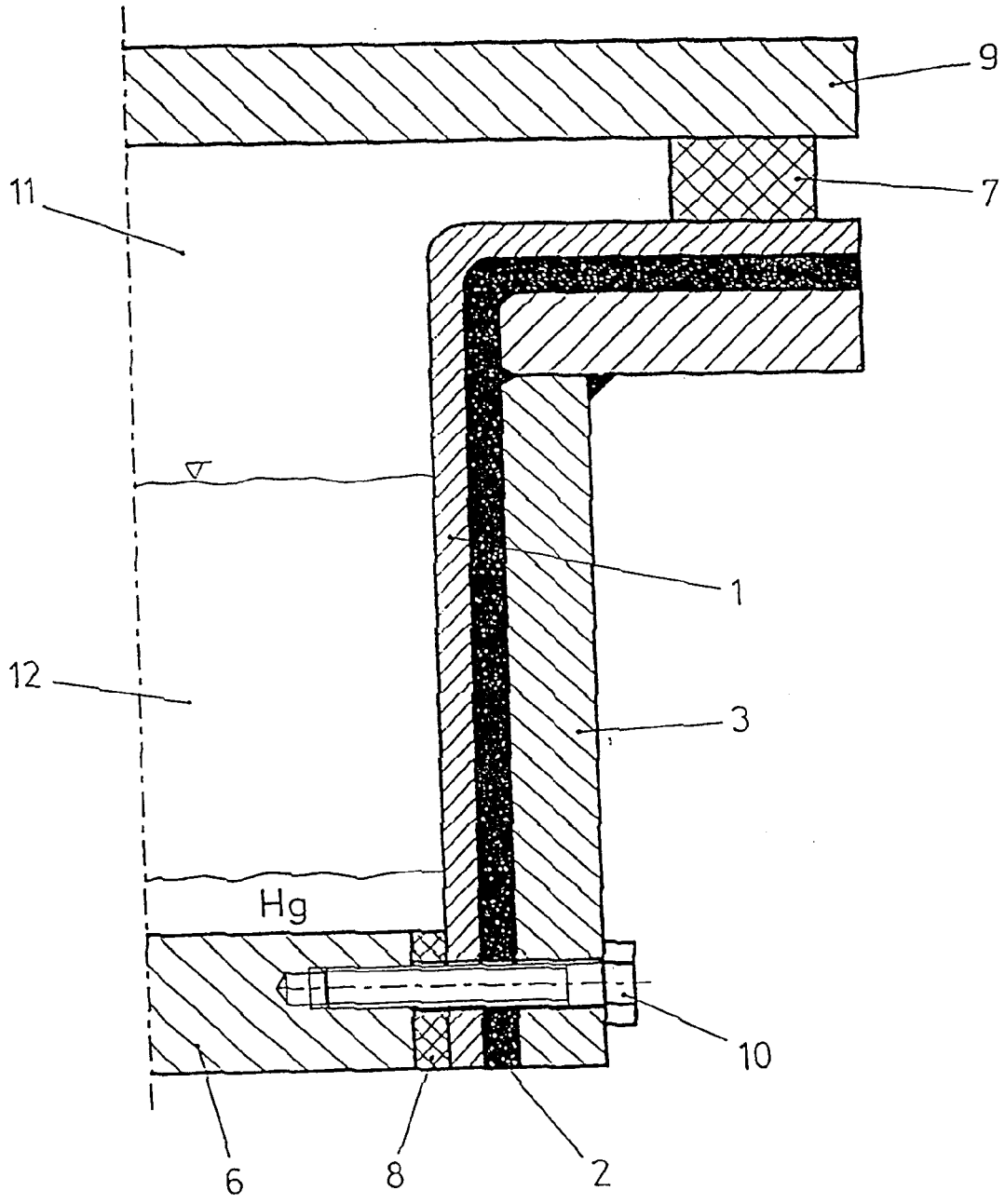
FIG. 2 shows part of an electrolytic cell with a side wall according to the invention.

FIG. 2 shows part of an electrolytic cell in the form of a section through a side wall 4. In order to prevent corrosion the inside of the side wall 4 is also provided with a coat of DD anti-corrosion paint. Chlorine-resistant seals 7 and 8 serve to close the gap between the cell cover 9 and side wall 4 and between the cell floor 6 and the side wall 4, in order to prevent the escape of chlorine-containing gas 11 or salt solution 12.

What is claimed is:

1. Anti-corrosion side wall (4) for apparatus for collecting chlorine-containing process gases, wherein a covering (1) of optionally welded or trimmed sheets of polyvinylidene fluoride (PVDF), polytetrafluoroethylene-co-hexafluoropropylene (FEP), polyvinyl chloride (PVC or PVC-HT) or perfluoroalkoxy polymer (PFA), is mounted on a metal support structure (3) that can be joined to the floor of the apparatus (6) or further side parts (4') by detachable securement means (10).

2. Side wall according to claim 1, wherein the covering (1) is fixed for mounting purposes on the support structure (3) with a detachable adhesive.

3. Side wall according to claim 1, wherein the support structure (3) is of steel or stainless steel construction.

4. Side wall according to claim 1, wherein an additional insulation layer (2) of closed-cell polymer foam is provided between the support structure (3) and covering (1).

5. The side wall of claim 4, wherein said polymer foam is a polyurethane foam.

* * * * *